US010267078B2

(12) United States Patent
Kobayashi et al.

(10) Patent No.: US 10,267,078 B2
(45) Date of Patent: Apr. 23, 2019

(54) VEHICULAR OPENING/CLOSING BODY CONTROL DEVICE

(71) Applicant: Aisin Seiki Kabushiki Kaisha, Kariya-shi (JP)

(72) Inventors: Kenta Kobayashi, Anjo (JP); Kohei Kobayashi, Ichinomiya (JP); Yoshihiro Takeda, Anjo (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 229 days.

(21) Appl. No.: 15/267,760

(22) Filed: Sep. 16, 2016

(65) Prior Publication Data

US 2017/0081894 A1 Mar. 23, 2017

(30) Foreign Application Priority Data

Sep. 18, 2015 (JP) ..... 2015-185606

(51) Int. Cl.
*E05F 15/41* (2015.01)
*E05F 15/73* (2015.01)
*E05F 15/643* (2015.01)
*E05F 15/659* (2015.01)

(52) U.S. Cl.
CPC ..... *E05F 15/41* (2015.01); *E05F 15/659* (2015.01); *E05F 15/643* (2015.01); *E05F 15/73* (2015.01)

(58) Field of Classification Search
CPC ..... E05F 15/41
USPC ..... 318/280, 34
See application file for complete search history.

(56) References Cited

U.S. PATENT DOCUMENTS 5,530,329 A * 6/1996 Shigematsu ..... H02H 7/0851 318/469
5,773,947 A * 6/1998 Torii ..... G01D 5/04 160/9
7,952,312 B2 * 5/2011 Sakai ..... G05B 9/02 318/256

FOREIGN PATENT DOCUMENTS

JP 2002-84783 3/2002
JP 2005-76319 3/2005

* cited by examiner

*Primary Examiner* — David Luo
(74) *Attorney, Agent, or Firm* — Oblon, McClelland, Maier & Neustadt, L.L.P.

(57) ABSTRACT

A vehicular opening/closing body control device includes: a driving control unit that performs a driving control of an opening/closing body; a position detection unit that detects a movement position of the opening/closing body by counting pulse signals synchronized with a movement of the opening/closing body; a storage unit that stores a maximum movement position of the opening/closing body using a starting end of a movement range of the opening/closing body as a reference; a determination unit that determines whether or not the maximum movement position is updated, in a case where the driving control of the opening/closing body towards a terminating end side of the movement range is performed; and a stop detection unit that determines that the opening/closing body is stopped in a case where a state where the maximum movement position is not updated continues for a predetermined time or longer.

5 Claims, 5 Drawing Sheets

VEHICULAR OPENING/CLOSING BODY CONTROL DEVICE

CROSS REFERENCE TO RELATED APPLICATIONS

This application is based on and claims priority under 35 U.S.C. § 119 to Japanese Patent Application 2015-185606, filed on Sep. 18, 2015, the entire contents of which are incorporated herein by reference.

TECHNICAL FIELD

This disclosure relates to a vehicular opening/closing body control device.

BACKGROUND DISCUSSION

In the related art, in a control device driving an opening/closing body of a vehicle such as a sliding door, there is a device to detect a movement position of the opening/closing body by counting (edge of) pulse signals synchronized with a movement of the opening/closing body. For example, a pulse sensor using a Hall element is used in a power sliding door device disclosed in JP2005-76319A (Reference 1). That is, generally, such a pulse sensor is provided with a rotation body that rotates in synchronization with the movement of the opening/closing body, and a pair of Hall elements facing a magnet provided in the rotation body on a periphery of the rotation body. For the pulse signal with two phases in which phases output from these two Hall elements are deviated from each other by 90°, by detecting the edge thereof, a movement direction and a movement position of the opening/closing body can be detected.

In a case where a new edge is no longer detected for the pulse signal, it is possible to determine that the opening/closing body has stopped. Thereby, without providing an additional configuration such as a limit switch, it is possible to detect that the opening/closing body reaches a terminating end of a movement range, that is, reaches a fully open or fully closed position.

However, the resolution of pulse sensors has improved in recent years. Therefore, in the detection method of the related art, an opening/closing body reaching a terminating end of a movement range may not be detected. That is, a vibration caused by an elastic deformation of a sealing member provided on a periphery of a sliding door, rattling of mechanical components, or torque variation of a motor as a driving source or the like may occur in the opening/closing body after a stop thereof. In a case where a pulse sensor with a high resolution is used, there is a problem that minute vibrations may be read as a movement position change of the opening/closing body.

That is, in the related art, as long as new edges of the pulse signals are continuously detected, a stop of the opening/closing body is not detected. Specifically, in order to simplify, such a problem is significant in a configuration using the pulse signal that a rotation sensor provided in the motor outputs. Since there is a problem that the configuration is complicated in a case of adding a new decoder in order to avoid this problem, there is room for improvement in this regard.

SUMMARY

Thus, a need exists for a vehicular opening/closing body control device which is not suspectable to the drawback mentioned above.

It is preferable that a vehicular opening/closing body control device according to an aspect of this disclosure includes a driving control unit that performs a driving control of an opening/closing body, a position detection unit that detects a movement position of the opening/closing body by counting pulse signals synchronized with a movement of the opening/closing body, a storage unit that stores a maximum movement position of the opening/closing body using a starting end of a movement range of the opening/closing body as a reference, a determination unit that determines whether or not the maximum movement position has been updated, in a case where the driving control of the opening/closing body towards a terminating end side of the movement range is performed, and a stop detection unit that determines that the opening/closing body has stopped in a case where a state where the maximum movement position is not updated continues for a predetermined time or longer.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here embodying a vehicular opening/closing body control device to a power sliding door device will be described with reference to drawings.

Figure 1:
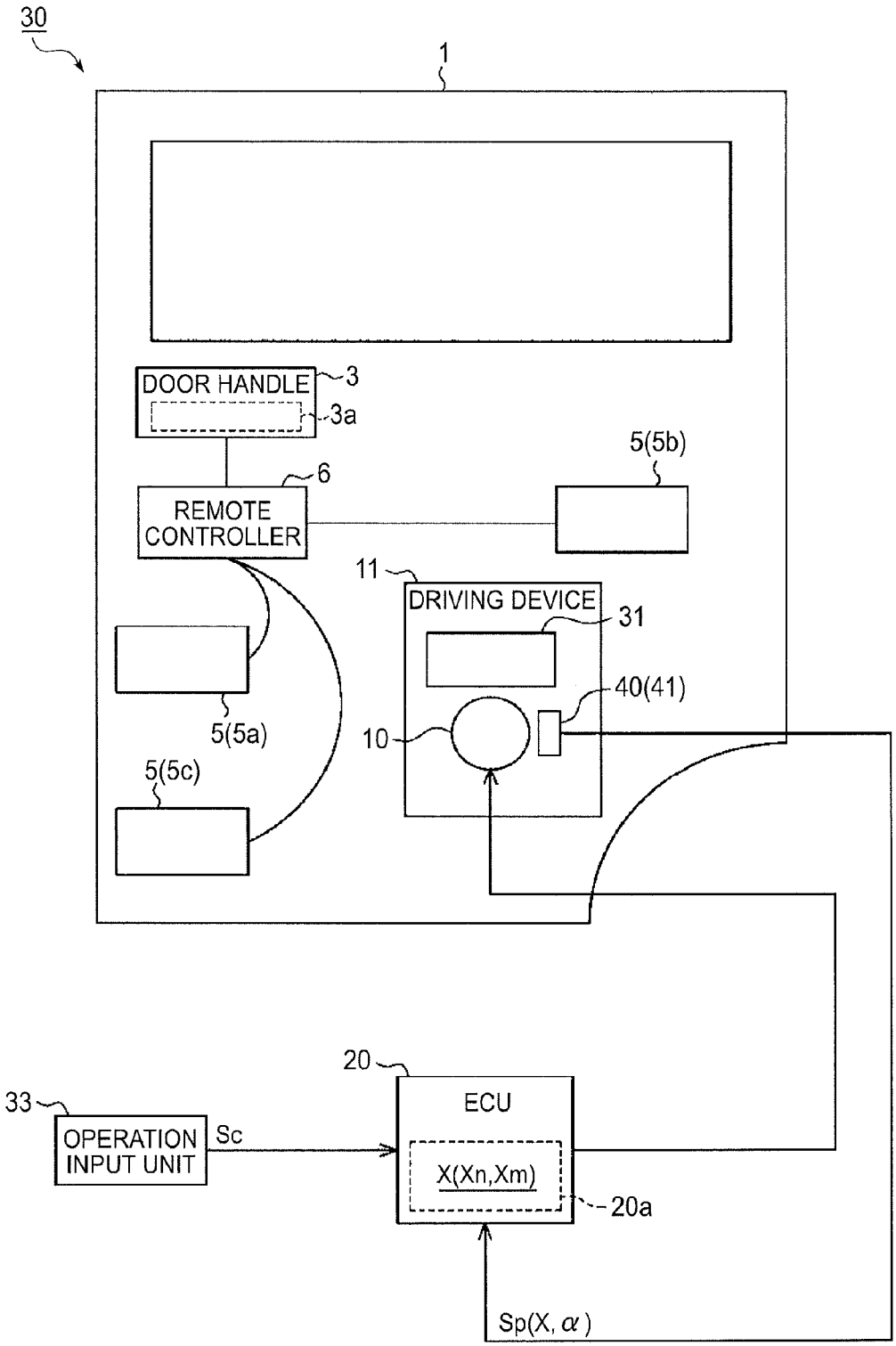
FIG. 1 is a schematic configuration diagram of a power sliding door device.

As illustrated in FIG. 1, the sliding door 1 as an opening/closing body supported on a side surface of a vehicle (not illustrated) moves in the front and rear direction so as to open and close a door opening part (not illustrated) provided on the side surface of the vehicle. Specifically, the sliding door 1 is configured so as to be a fully closed state in which the door opening part is closed by moving to the vehicle front side (left side in FIG. 1), and so as to be a fully open state in which a passenger can be getting on and off through the door opening part by moving to the vehicle rear side (right side in FIG. 1). A door handle 3 for an opening and closing operation of the sliding door 1 is provided in the sliding door 1.

A plurality of lock devices 5 are provided in the sliding door 1. A front lock 5*a* and a rear lock 5*b* as a fully closed lock restraining the sliding door 1 in a fully closed position are provided in the sliding door 1. Furthermore, a fully open lock 5*c* for restraining the sliding door 1 in a fully open position is provided in the sliding door 1. Each of these lock devices 5 is connected to the door handle 3 via a remote controller 6 in the sliding door 1 of the embodiment.

That is, in the sliding door 1 of the embodiment, when an operation unit (outer handle and inner handle) 3*a* of the door handle 3 is operated, a restraint state of each of the lock devices 5 is released. The sliding door 1 is able to release the restraint state of each of the lock devices 5 by not only a remote operation but also an operation switch provided in a vehicle cabin or a portable device operated by the passenger. An opening operation and a closing operation of the sliding door 1 can be manually performed using the door handle 3 as a gripping portion.

A driving device 11 using a motor 10 as a driving source is provided in the sliding door 1 of the embodiment. Furthermore, in the driving device 11, an operation thereof is controlled by an ECU 20. Thereby, in the embodiment, the power sliding door device 30 is formed as the vehicular opening/closing body control device capable of performing an opening operation and a closing operation of the sliding door 1 based on a driving force of the motor 10.

In detail, the driving device 11 of the embodiment is provided with a drum device 31 rotating based on the driving force of the motor 10. In the embodiment, a rotation of the motor 10 decelerated by a speed reduction mechanism is transmitted to the drum device 31 configuring a drive mechanism of the sliding door 1. The driving device 11 of the embodiment has a well-known configuration driving for opening and closing the sliding door 1 via a driving cable (not illustrated) that can be wound by the drum device 31.

On the other hand, an output signal of an operation input unit 33 (operation input signal Sc) provided in the door handle 3, the vehicle cabin or the portable device is input in the ECU 20 of the embodiment. That is, the ECU 20 of the embodiment detects an operation request of the sliding door 1 by a user based on this operation input signal Sc. In order to move the sliding door 1 to a requested operation direction, a configuration which controls the operation of the driving device 11 is formed.

The power sliding door device 30 of the embodiment is provided with a pulse sensor 40 that outputs a pulse signal Sp synchronized with the sliding door 1 which is moved by being driven by the driving device 11. In the embodiment, a rotation sensor 41 provided in the motor 10 of the driving device 11 is used in the pulse sensor 40. Specifically, the rotation sensor 41 has a well-known configuration that is provided with a ring magnet that integrally rotates with a rotating shaft of the motor 10 and a pair of Hall elements facing to the ring magnet (not illustrated). That is, the pulse sensor 40 of the embodiment is synchronized with the rotation of the motor 10 for driving the sliding door 1, and outputs the pulse signal Sp with two phases in which the phases are deviated from each other by 90°. The ECU 20 of the embodiment is configured to detect and count an edge of the pulse signal Sp and thereby to detect a movement direction and a movement position (door position X) of the sliding door 1 which is moved by the driving of the motor.

Figure 2:
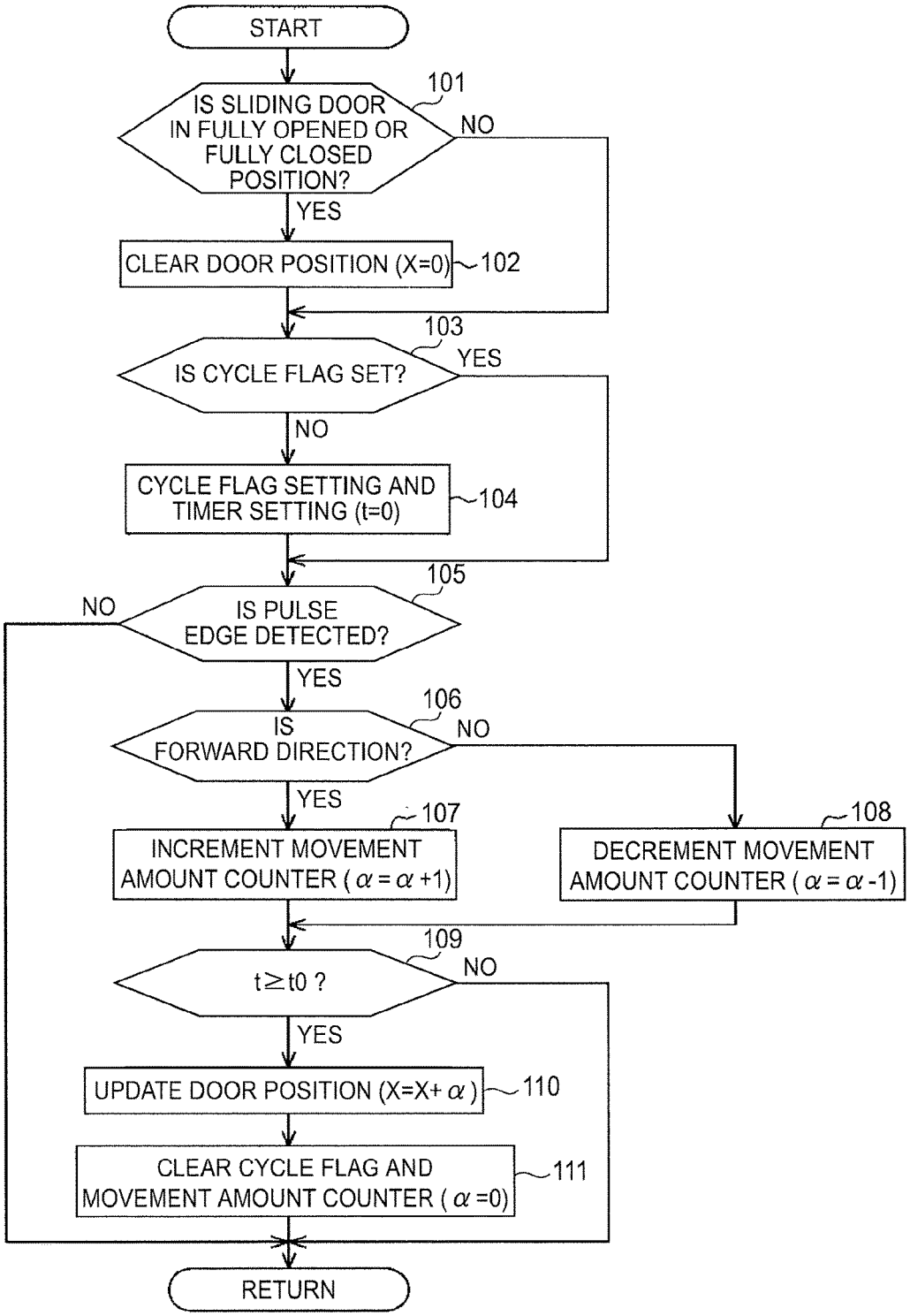
FIG. 2 is a flowchart illustrating a processing procedure for movement position detection of a sliding door based on a count of a pulse signal.

Further in detail, as illustrated in a flowchart of FIG. 2, the ECU 20 of the embodiment determines whether or not the sliding door 1 is in a fully open or fully closed position (Step 101), and in a case where the sliding door 1 is in the fully open or fully closed position (Step 101: YES), clears the door position X held in a storage region 20*a* (refer to FIG. 1) (X=0, Step 102). Next, the ECU 20 determines whether or not a cycle flag is set (Step 103), and in a case where the cycle flag is not set (Step 103: NO), sets the cycle flag and sets a timer for clocking (time t=0, Step 104). In above Step 101, in a case where the sliding door 1 is determined to be in an intermediate position (Step 101: NO), the ECU 20 does not perform the processing of above Step 102. In above Step 103, in a case where the cycle flag is determined to be previously set (Step 103: YES), the ECU 20 does not perform the processing of above Step 104.

Next, the ECU 20 determines whether or not the edge of the pulse signal Sp which the pulse sensor 40 outputs is detected (Step 105), and in a case where the edge is detected (Step 105: YES), determines whether or not the movement direction of the sliding door 1 indicated in the detected edge is a forward direction (Step 106). That is, in above Step 101 and Step 102, in a case where the sliding door 1 is in the fully closed position so that the door position X is cleared, the ECU 20 determines whether or not the movement direction is an opening operation direction, and in a case where the sliding door 1 is in the fully open position so that the door position X is cleared, the ECU 20 determines whether or not the movement direction is a closing operation direction. In a case where the movement direction of the sliding door 1 is the forward direction (Step 106: YES), the ECU 20 increments a movement amount counter ($\alpha=\alpha+1$, Step 107), and in a case where the movement direction of the sliding door 1 is a reverse direction (Step 106: NO), the ECU 20 decrements the movement amount counter ($\alpha=\alpha-1$, Step 108).

Furthermore, the ECU 20 determines whether or not a predetermined time t0 elapses from the time when the cycle flag is set in above Step 104 (Step 109). In a case where the predetermined time t0 elapses from the time when the cycle flag is set ($t \geq t0$, Step 109: YES), the ECU 20 updates a value of the door position X by adding a value of the above movement amount counter, that is, the movement amount a per the predetermined time t0 ($X=X+\alpha$, Step 110), and clears the movement amount counter and the cycle flag ($\alpha=0$, Step 111).

In a case where it is determined that the predetermined time t0 does not elapse from the time when the cycle flag is set ($t<t0$, Step 109: NO) in above Step 109, the ECU 20 does not perform the processing of above Step 110 and Step 111. In a case where it is determined that the edge of the pulse signal Sp is not detected (Step 105: NO) in above Step 105, the ECU 20 does not perform the processing of above Step 106 to Step 111.

Figure 3:
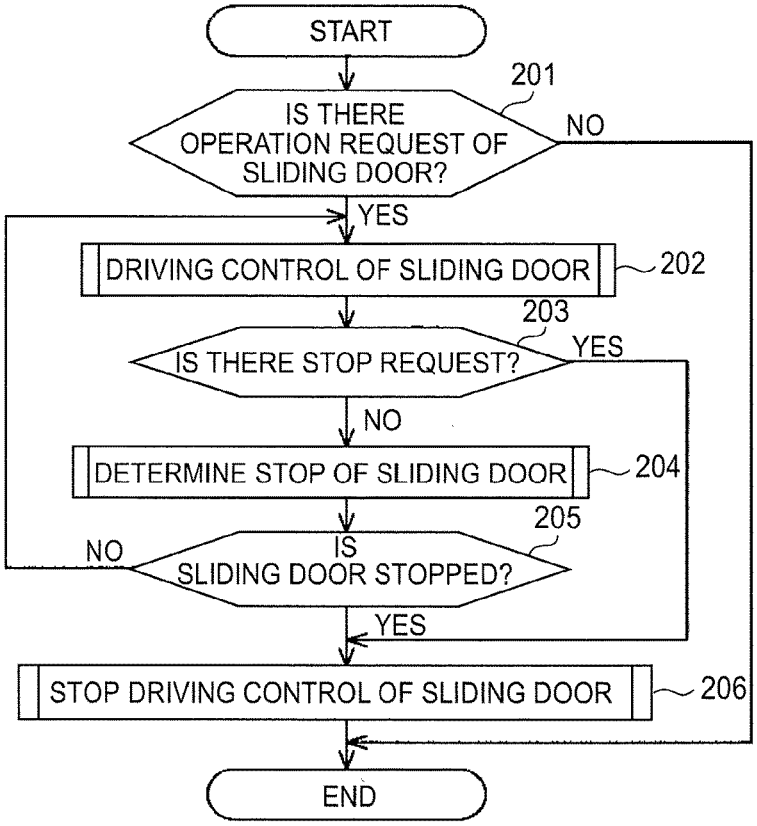
FIG. 3 is a flowchart illustrating a processing procedure for a driving control of the sliding door.

As illustrated in a flowchart of FIG. 3, in a case where a driving control of the sliding door 1 is started based on the operation request indicated in the operation input signal Sc (Step 201: YES and Step 202), the ECU 20 of the embodiment determines whether or not a stop request of the driving control is present (Step 203), and performs stop determination of the sliding door 1 (Step 204). In a case of detecting the stop request of the driving control (Step 203: YES) or detecting the stop of the sliding door 1 (Step 205: YES), the ECU 20 stops the driving control of the sliding door 1 (Step 206).

That is, in a case where the stop request of the driving control is absent (Step 203: NO), and the stop of the sliding door 1 is not detected (Step 205: NO), the ECU 20 of the embodiment continues the driving control of the sliding door 1. Thereby, the power sliding door device 30 of the embodiment is configured to complete the opening operation or closing operation of the sliding door 1 that the passenger operating the operation input unit 33 desires.

Figure 4:
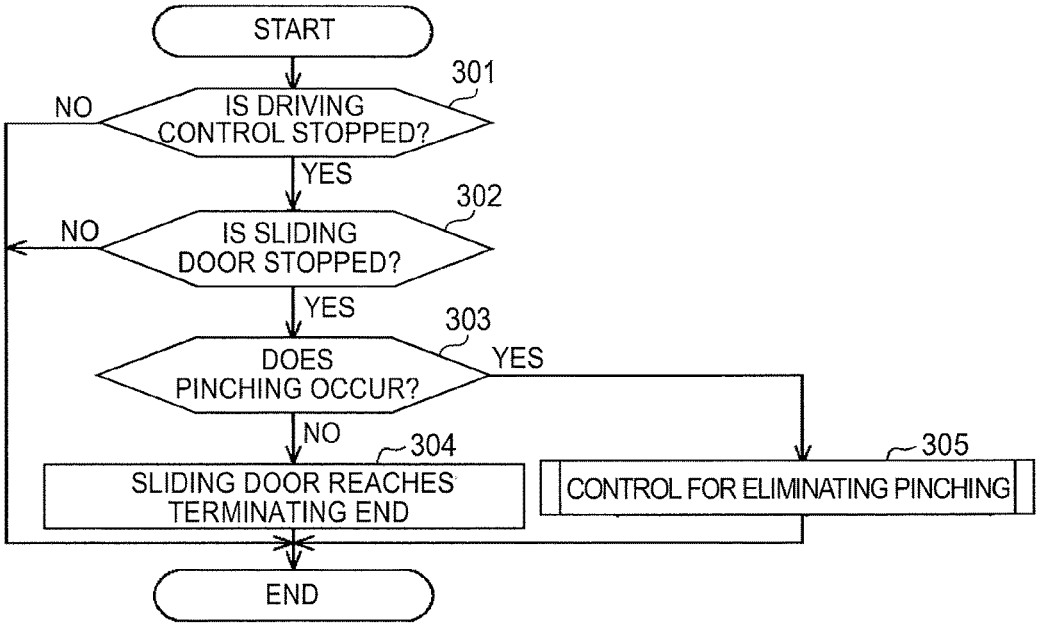
FIG. 4 is a flowchart illustrating a processing procedure for terminating end arrival determination of the sliding door.

As illustrated in a flowchart of FIG. 4, in a case where the driving control of the sliding door 1 is stopped by detecting the stop of the sliding door 1 (Step 301: YES and Step 302: YES), the ECU 20 of the embodiment determines whether or not a pinching of a foreign matter occurs in the sliding door 1 (Step 303). In the embodiment, detection determination of the pinching in Step 303 is performed based on a sensor output of a touch sensor (not illustrated) provided in the sliding door 1. In a case where it is determined that the pinching does not occur in the sliding door 1 (Step 303: NO), the ECU 20 is configured to determine that the sliding door 1 reaches a terminating end of a movement range, that is, the fully open position at the time of the opening operation and the fully closed position at the time of the closing operation (Step 304).

In a case where the pinching generated in the sliding door 1 is detected (Step 303: YES) in above Step 303, the ECU 20 of the embodiment is configured to perform the control for eliminating the pinching such as the sliding door 1 being subjected to be reversely operated (Step 305) in order to eliminate the pinching.

Stop Determination of Sliding Door

Next, the stop determination of the sliding door 1 that the ECU 20 of the embodiment performs will be described.

As illustrated in FIG. 1, the ECU 20 of the embodiment holds a current value Xn of the door position X (refer to FIG. 2, Step 110) in the storage region 20*a*. The ECU 20 stores (holds) the current value Xn of the door position X and a maximum value Xm of the door position X, that is, a maximum movement position of the sliding door 1 using the fully open or fully closed position (refer to FIG. 2, Step 102) set as the starting end of the movement range (X=0) as a reference. The ECU 20 of the embodiment is configured to perform the stop determination of the sliding door 1 based on a comparison between the current value Xn and the maximum value Xm of the door position X.

Figure 5:
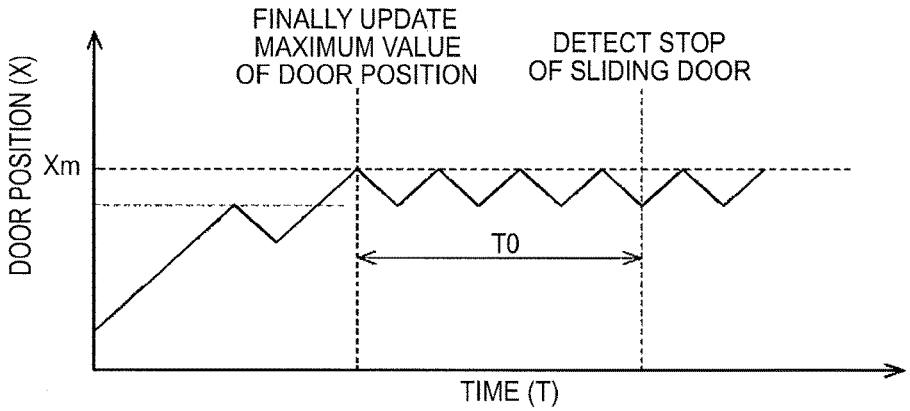
FIG. 5 is a view illustrating stop determination of the sliding door based on the count of the pulse signal.

In detail, as illustrated in FIG. 5, in a case where an opening driving control of the sliding door 1 setting the fully closed position as the starting end (X=0) or a closing driving control setting the fully open position as the starting end is performed, the maximum value Xm of the door position X held in the storage region 20*a* of the ECU 20 is updated by the current value Xn of the newly detected door position X for each detection period based on a count of the pulse signal Sp. The update of the maximum value Xm by the current value Xn of the newly detected door position X is continued until a movement in a driving direction is restricted so that the sliding door 1 stops.

In other words, in a case where the sliding door 1 is stopped during such driving control, after that, the current value Xn of the newly detected door position X does not exceed the maximum value Xm of the door position X held in the storage region 20*a* of the ECU 20. This is the same even in a case where the pulse sensor 40 used to detect the door position X has a high resolution reading minute vibrations generated in the sliding door 1 after stopping, that is, in a case where the current value Xn of the door position X detected based on the count of the pulse signal Sp does not remain at a constant value after the sliding door 1 is stopped.

Based on this point, in a case where such driving control of the sliding door 1 towards the terminating end of the movement range is performed, the ECU 20 of the embodiment determines whether or not the current value Xn of the newly detected door position X is equal to or less than the maximum value Xm of the door position X held in the storage region 20*a*. In a situation where the current value Xn of the door position X is equal to or less than the maximum value Xm of the door position X, that is, in a case where a state where the maximum value Xm of the door position X is not updated continues for the predetermined time T0 or longer, the ECU 20 is configured to determine that the sliding door 1 is stopped.

Figure 6:
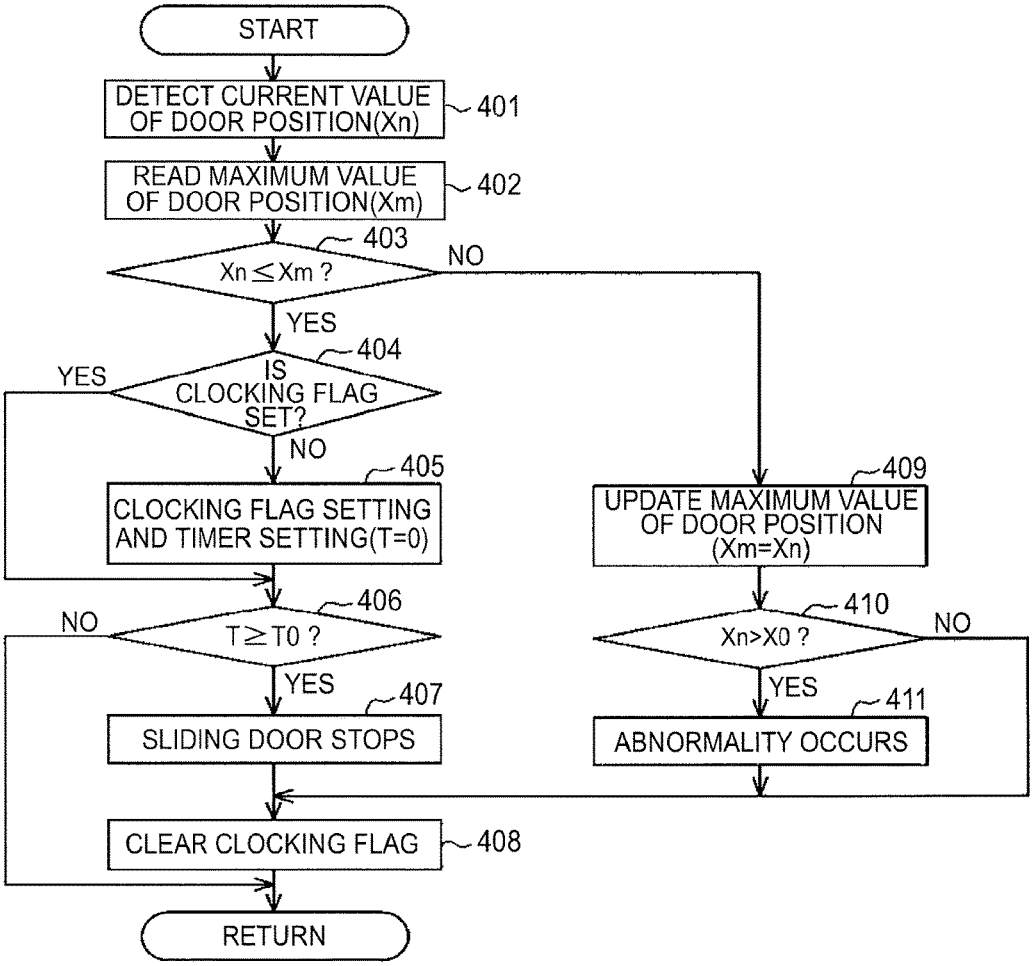
FIG. 6 is a flowchart illustrating a processing procedure for the stop determination of the sliding door based on the count of the pulse signal.

Specifically, as illustrated in a flowchart of FIG. 6, when the current value Xn of the door position X is detected (Step 401), the ECU 20 of the embodiment reads the maximum value Xm of the door position X held in the storage region 20*a* (Step 402), and compares the current value Xn of the door position X and the maximum value Xm of the door position X (Step 403).

Next, in comparison and determination of Step 403, in a case where the current value Xn of the door position X is equal to or less than the maximum value Xm of the door position X (Xn Xm, Step 403: YES), the ECU 20 subsequently determines whether or not a clocking flag is set (Step 404). In a case where the clocking flag is not set (Step 404: NO), the ECU 20 sets the clocking flag, and sets the timer for clocking (time T=0, Step 405). In a case where the clocking flag is set previously (Step 404: YES), the ECU 20 does not perform the processing of Step 405.

Furthermore, the ECU 20 determines whether or not the predetermined time T0 elapses from the time of when the clocking flag is set in above Step 405 (Step 406). In a case where the predetermined time T0 elapses (T≥T0, Step 406: YES), the ECU 20 determines that the sliding door 1 is stopped (Step 407), and clears the clocking flag (Step 408).

On the other hand, in above Step 403, in a case where it is determined that the current value Xn of the door position X is larger than the maximum value Xm of the door position X (Xn>Xm, Step 403: NO), the ECU 20 updates the maximum value Xm of the door position X by the current value Xn of the door position X (Xm=Xn, Step 409). Furthermore, the ECU 20 of the embodiment determines whether or not the current value Xn of the door position X updating the maximum value Xm of the door position X in Step 409 exceeds a predetermined threshold X0 that is set in advance (Step 410). In a case where the current value Xn of the door position X exceeds the predetermined threshold X0, that is, in a case where the current value Xn exceeds the predetermined threshold X0, and the maximum value Xm of the door position X is updated (Xn>X0, Step 410: YES), the ECU 20 is configured to determine that certain abnormality occurs (Step 411).

The ECU 20 of the embodiment performs above Step 408 so as to clear the clocking flag after detecting the abnormality in Step 411. In above Step 410, in a case where the current value Xn of the door position X is equal to or less than the predetermined threshold X0, that is, in a case where it is determined that the maximum value Xm of the door position X does not exceed the predetermined threshold X0 (Xm≤X0, Step 410: NO), the ECU 20 does not perform the processing of Step 411, and clears the clocking flag in above Step 408. In above Step 406, in a case where it is determined that the predetermined time T0 does not elapse from the time when the clocking flag is set (T<T0, Step 406: NO), the ECU 20 does not perform the processing of above Step 407 and Step 408.

Hereinbefore, according to the embodiment, the following effects can be obtained.

(1) The ECU 20 as a driving control unit controls the operation of the driving device 11 using the motor 10 as the driving source so as to perform the driving control of the sliding door 1. The ECU 20 as a position detection unit and a storage unit detects the movement position (door position X) of the sliding door 1 by counting the pulse signals Sp synchronized with the movement of the sliding door 1 and stores the maximum movement position (maximum value Xm) of the sliding door 1 using the fully open or fully closed position which is the starting end of the movement range as a reference. Furthermore, in a case where the driving control of the sliding door 1 towards a terminating end side of the movement range is performed, the ECU 20 as a determination unit determines whether or not the maximum value Xm of the door position X is updated. In a case where the state where the maximum value Xm of the door position X is not updated continues for the predetermined time T0 or longer, the ECU 20 as a stop detection unit determines that the sliding door 1 is stopped.

According to the above-described configuration, even in a case where the pulse sensor 40 used to detect the door position X has high resolution reading the minute vibrations generated in the sliding door 1 after stopping, and the door position X detected based on the count of the pulse signal Sp does not remain at the constant value after the sliding door 1 is stopped, the stop of the sliding door 1 can be more reliably detected. In addition, there is an advantage that a configuration is simple and a usage amount of the storage region 20*a* is small.

(2) The ECU 20, using the rotation sensor 41 provided in the motor 10 as the pulse sensor 40, acquires the pulse signal Sp synchronized with the rotation of the motor 10 for driving the sliding door 1.

That is, in many cases, the rotation sensor 41 of the motor 10 has high resolution. Furthermore, the pulse signal Sp is the signal synchronized with the motor revolution before being decelerated in the driving device 11. Accordingly, it is possible to obtain a more significant effect by applying the configuration of above (1) to this unit.

(3) In a case where the stop of the sliding door 1 is detected, the ECU 20 determines that the sliding door 1 reaches the terminating end of the movement range, on the condition that the pinching of the foreign matter does not occur in the sliding door 1.

That is, in a case where the driving control of the sliding door 1 is performed, the movement in the movement direction is restricted so that the sliding door 1 stops. Accordingly, in a case where the driving control causes the sliding door 1 to move towards the terminating end side of the movement range, and the stop of the sliding door 1 is not due to the pinching of the foreign matter, it is possible to assume that the sliding door 1 reaches the terminating end of the movement range. Thereby, for example, it is possible to eliminate a configuration to detect the arrival at the terminating end of the movement range such as a limit switch and to simplify the configuration.

(4) In a case where the stop of the sliding door 1 is detected, the ECU 20 stops the driving control of the sliding door 1 towards the terminating end side of the movement range. In a case where the maximum value Xm of the door position X exceeds the predetermined threshold X0 and is updated, the ECU 20 determines that certain abnormality occurs.

That is, the driving control of the sliding door 1 towards the terminating end side of the movement range is performed so that the sliding door 1 reaches the terminating end of the movement range before long. Accordingly, in a case where the maximum value Xm of the door position X is updated beyond the movement position range of the sliding door 1 assumed to reach the terminating end of the movement range, it is possible to assume that certain abnormality occurs. In this case, the driving control of the sliding door 1 is immediately stopped so that it is possible to secure a high reliability.

The above-described embodiment may be changed as follows.

In the above-described embodiment, the power sliding door device 30 that performs an opening and closing operation of the sliding door 1 provided on the side surface of the vehicle is embodied. However, without being limited thereto, the embodiment may be applied to the vehicular opening/closing body control device targeting the opening/closing body other than the sliding door such as a sunroof device.

In the above-described embodiment, the rotation sensor 41 provided in the motor 10 of the driving device 11 is used for the pulse sensor 40. The pulse sensor 40 is synchronized with the rotation of the motor 10 for driving the sliding door 1 and outputs the pulse signal Sp with two phases. However, without being limited thereto, insofar as the sensor outputs the pulse signal Sp synchronized with the movement of the sliding door 1, for example, it may be configured to be provided with the pulse sensor 40 in the speed reduction mechanism of the motor 10 or in the drive mechanism of the sliding door 1 such as the drum device 31. The configuration of the pulse sensor 40 may be arbitrarily changed. The pulse sensor 40 may be a sensor that outputs a pulse signal with three phases or more.

In the above-described embodiment, regardless of the current value Xn of the door position X, in a case where the state where the maximum value Xm of the door position X is not updated continues for the predetermined time T0 or longer, it is determined that the sliding door 1 is stopped. However, without being limited thereto, it may be configured to determine that the sliding door 1 is stopped on the condition that (current value Xn of) the door position X is in the terminating end position range (X1<Xn<X2) that is defined by the first and second predetermined values X1, and X2 set in advance.

Figure 7:
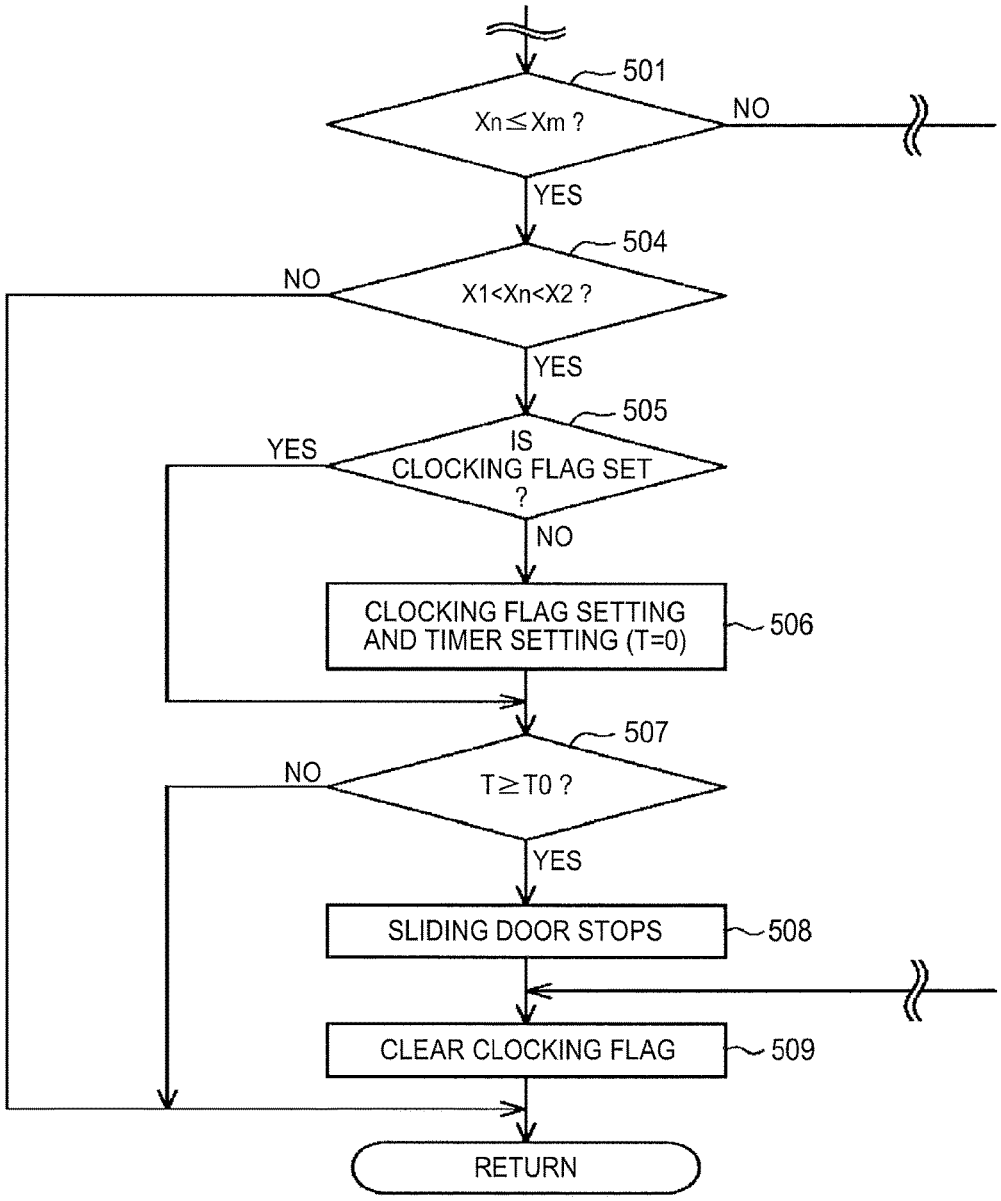
FIG. 7 is a flowchart illustrating a processing procedure of another example relating to stop determination of the sliding door based a count of the pulse signal.

Specifically, for example, as illustrated in a flowchart of FIG. 7, in the comparison determination of Step 503, in a case where the current value Xn of the door position X is determined to be equal to or less than the maximum value Xm of the door position X (Step 503: YES), the ECU 20 subsequently determines whether or not the current value Xn of the door position X is in the terminating end position range set in advance (Step 504). Step 501 to Step 503 in this case may be the same as Step 401 to Step 403 in the flowchart of FIG. 6, and Step 505 and thereafter may be the same as Step 404 to Step 411 in the flowchart of FIG. 6 (a portion is not illustrated). In a case where the current value Xn of the door position X is in the terminating end position range (X1<Xn<X2, Step 504: YES), it may be configured to perform the determination of Step 505 to Step 506 for the predetermined time. By adopting such a configuration, the stop of the sliding door 1 can be detected with high accuracy by reaching the terminating end of the movement range.

In the above-described embodiment, by successively adding the movement amount a of the sliding door 1 per the predetermined time t0 detected by counting the pulse signals Sp to the door position X, the value of the door position X is periodically updated (detected) ($X=X+\alpha$). However, without being limited thereto, it may be configured to update the door position X for each counting of (the edge of) the pulse signals Sp.

Next, technical ideas that can be grasped from the above embodiments will be described with the effect.

It is preferable that a vehicular opening/closing body control device according to an aspect of this disclosure includes a driving control unit that performs a driving control of an opening/closing body, a position detection unit that detects a movement position of the opening/closing body by counting pulse signals synchronized with a movement of the opening/closing body, a storage unit that stores a maximum movement position of the opening/closing body using a starting end of a movement range of the opening/closing body as a reference, a determination unit that determines whether or not the maximum movement position has been updated, in a case where the driving control of the opening/closing body towards a terminating end side of the movement range is performed, and a stop detection unit that determines that the opening/closing body has stopped in a case where a state where the maximum movement position is not updated continues for a predetermined time or longer.

According to the above-described configuration, even in a case where the pulse sensor used to detect the movement position of the opening/closing body has a high resolution reading the minute vibrations generated in the opening/closing body after stopping, and the movement position of the opening/closing body detected based on the count of the pulse signal does not remain at a constant value after the opening/closing body is stopped, the stop of the opening/closing body can be more reliably detected.

In the vehicular opening/closing body control device, it is preferable that the pulse signal is a signal that a rotation sensor provided in a motor outputs.

That is, in many cases, the rotation sensor of the motor has high resolution. Furthermore, the pulse signal is the signal synchronized with the motor revolution before being decelerated in the driving device. Accordingly, it is possible to obtain more significant effects by applying the above-described configuration to this device.

In the vehicular opening/closing body control device, it is preferable that the stop detection unit determines that the opening/closing body is stopped on a condition that the movement position of the opening/closing body is within a terminating end position range which is set in advance.

According to the above-described configuration, the stop of the opening/closing body can be detected with high accuracy when reaching the terminating end of the movement range.

It is preferable that the vehicular opening/closing body control device includes a terminating end arrival detection unit that determines that the opening/closing body reaches a terminating end of the movement range in a case where a pinching does not occur in the opening/closing body in a case where a stop of the opening/closing body is detected.

That is, in a case where the driving control of the opening/closing body is performed, the movement in the movement direction is restricted so that the opening/closing body stops. Accordingly, in a case where the driving control causes the opening/closing body to move towards the terminating end side of the movement range, and the stop of the opening/closing body is not due to the pinching of the foreign matter, it is possible to assume that the opening/closing body reaches the terminating end of the movement range. Thereby, for example, it is possible to eliminate the configuration to detect the arrival at the terminating end of the movement range such as the limit switch and to simplify the configuration.

It is preferable that the vehicular opening/closing body control device includes a driving control stop unit that stops the driving control of the opening/closing body towards the terminating end side of the movement range in a case where the stop of the opening/closing body is detected, and an abnormality detection unit that determines that an abnormality occurs in a case where the movement position of the opening/closing body exceeds a predetermined threshold.

That is, the driving control of the opening/closing body towards the terminating end side of the movement range is performed so that the opening/closing body reaches the terminating end of the movement range before long. Accordingly, in a case where the maximum movement position of the opening/closing body is updated beyond the movement position range of the opening/closing body that is assumed to reach the terminating end of the movement range, it is possible to assume that certain abnormality occurs. In this case, the driving control thereof is immediately stopped so that it is possible to secure a high reliability.

It is preferable that the vehicular opening/closing body control device includes the driving device that drives the opening/closing body of the vehicle using the motor as the driving source, a control device that controls the operation of the driving device, and the pulse sensor that outputs the pulse signal synchronized with the movement of the opening/closing body. The control device includes the position detection unit that detects the movement position of the opening/closing body by counting the pulse signals synchronized with the movement of the opening/closing body, the storage unit that stores the maximum movement position of the opening/closing body using the starting end of the movement range of the opening/closing body as a reference, the determination unit that determines whether or not the maximum movement position is updated, in a case where the driving control of the opening/closing body towards the terminating end side of the movement range is performed, and the stop detection unit that determines that the opening/closing body is stopped in a case where a state where the maximum movement position is not updated continues for the predetermined time or longer.

According to the aspect of this disclosure, even in a case where the resolution of the pulse sensor is high, the stop of the opening/closing body can be more reliably detected based on the count of the pulse signal.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicular opening/closing body control device comprising:

a driving control unit that performs a driving control of an opening/closing body;

a position detection unit that detects a movement position of the opening/closing body by counting pulse signals synchronized with a movement of the opening/closing body;

a storage unit that stores a maximum movement position of the opening/closing body using a starting end of a movement range of the opening/closing body as a reference;

a determination unit that determines whether or not the maximum movement position is updated, in a case where the driving control of the opening/closing body towards a terminating end side of the movement range is performed; and a stop detection unit that determines that the opening/closing body is stopped in a case where a state where the maximum movement position is not updated continues for a predetermined time or longer, wherein the stop detection unit determines that the opening/closing body is stopped on a condition that the movement position of the opening/closing body is within a terminating end position range which is set in advance.

2. The vehicular opening/closing body control device according to claim 1, wherein the pulse signal is a signal that a rotation sensor provided in a motor outputs.

3. The vehicular opening/closing body control device according to claim 1, further comprising:

a terminating end arrival detection unit that determines that the opening/closing body reaches a terminating end of the movement range in a case where a pinching does not occur in the opening/closing body in a case where a stop of the opening/closing body is detected.

4. The vehicular opening/closing body control device according to claim 1, further comprising:

a driving control stop unit that stops the driving control of the opening/closing body towards the terminating end side in the movement range in a case where the stop of the opening/closing body is detected; and an abnormality detection unit that determines that an abnormality occurs in a case where the movement position of the opening/closing body exceeds a predetermined threshold.

5. A vehicular opening/closing body control device comprising:

a driving device that drives an opening/closing body of a vehicle using a motor as a driving source;

a control device that controls an operation of the driving device; and a pulse sensor that outputs a pulse signal synchronized with a movement of the opening/closing body, wherein the control device includes a position detection unit that detects a movement position of the opening/closing body by counting the pulse signals synchronized with the movement of the opening/closing body, a storage unit that stores a maximum movement position of the opening/closing body using a starting end of the movement range of the opening/closing body as a reference, a determination unit that determines whether or not the maximum movement position is updated, in a case where the driving control of the opening/closing body towards a terminating end side of the movement range is performed, and a stop detection unit that determines that the opening/closing body is stopped in a case where a state where the maximum movement position is not updated continues for a predetermined time or longer, and wherein the stop detection unit determines that the opening/closing body is stopped on a condition that the movement position of the opening/closing body is within a terminating end position range which is set in advance.

* * * * *